US005092223A

United States Patent [19]

Hudson

[11] Patent Number: 5,092,223

[45] Date of Patent: Mar. 3, 1992

[54] MUZZLE BRAKE AND FLASH HIDER

[76] Inventor: Lee C. Hudson, 1431 W. Behrend Dr., Phoenix, Ariz. 85027

[21] Appl. No.: 644,092

[22] Filed: Jan. 22, 1991

[51] Int. Cl.[5] ..... F41A 21/34; F41A 21/36

[52] U.S. Cl. ..... 89/14.2; 89/14.3

[58] Field of Search ..... 89/14.2, 14.3, 14.4

[56] References Cited

U.S. PATENT DOCUMENTS

| | | | |
|---|---|---|---|
| 812,140 | 2/1906 | Kent | 89/14.3 |
| 2,192,081 | 2/1940 | Hughes | 89/14.3 |
| 2,206,567 | 7/1940 | Hughes | 89/14.3 |
| 2,212,683 | 8/1940 | Hughes | 89/14.3 |
| 2,212,686 | 8/1940 | Hughes | 89/14.3 |
| 2,953,972 | 9/1960 | Sorensen | 89/14.3 |
| 3,455,203 | 7/1969 | Pillersdorf | 89/14.3 |
| 4,322,999 | 4/1982 | Aston | 89/14.3 |
| 4,879,942 | 11/1989 | Cave | 89/14.2 |

*Primary Examiner*—David H. Brown
*Attorney, Agent, or Firm*—James F. Duffy

[57] ABSTRACT

An improved muzzle brake having a generally upward opening void from which escaping gases create a downwardly directed reaction force and a sloping face on which the propelling gases collide and expand and deflect to either side and upward of the muzzle brake to defeat the natural tendency of the muzzle of a weapon to climb and drift. Below the generally upward opening void, within the floor of the bore of the muzzle is a venturi trough in which a lowered pressure region of propelling gases is created by the high speed passage of the propelling gases down to the bore of the muzzle brake. This lowered pressure region within the venturi trough is still in excess of the environmental pressure exterior of the muzzle brake so that gases within the venturi trough escape through channels directed downwardly and to the left and right of the projectile path. Gas escaping through these downward, left and right deflected channels is adjustable in flow so that any tendency of the weapon to drift left or right or to move downwardly may be compensated for. The muzzle brake has a structural shape which accommodates it to be fitted within a government issued flash hider. Once so housed within the flash hider, further modification is made to introduce retrojet gas escape channels through the walls of the flash hider into the bore through which the projectile and its propelling gases pass. Propelling gases escaping through these rearwardly directed retrojet channels offset the recoil of the weapon. By arraying these retrojet channels, a balanced set of reaction forces is derived which tends to offset transverse movement of the muzzle of the weapon.

21 Claims, 1 Drawing Sheet

MUZZLE BRAKE AND FLASH HIDER

BACKGROUND

1. Field of the Invention

The invention relates to a muzzle brake for automatic weapons. The invention further relates to the retro-fitting of a muzzle brake in an existing government issued flash hider for automatic weapons.

2. Prior Art

Rapid fire weapons, such as machine guns and semi-automatic rifles, experience muzzle travel to the right and upwards as their projectiles and propellant gases are emitted from the muzzle. To prevent such travel, muzzle brakes are employed to divert the path of the gases- the gas being diverted to provide a reactionary force to offset the nominal travel of the weapon. All muzzle brakes employ a large opening which opens from the weapon's bore upwards with respect to the path of the projectile. Existing, known muzzle brakes generally achieve only somewhat satisfactory results in inhibiting muzzle travel of a rapidly firing weapon. It is the intent of the invention disclosed herein to significantly improve upon prior art muzzle brakes. Indeed, a prototype of the muzzle brake described herein performed so efficiently that the shooter was able to maintain on target, a weapon, held in one hand, and fired at full automatic setting.

SUMMARY OF THE INVENTION

The invention is disclosed and claimed as an improvement in a muzzle brake which is attachable to the muzzle of a weapon. The muzzle brake has a bore through which a projectile and propelling gases pass in exiting the muzzle. There is an opening above the bore for venting a portion of the propelling gases so as to create a downward reaction force to offset the nominal rise of the muzzle experienced when the weapon is fired. Several aspects of the improvement are disclosed and claimed.

In a first aspect of the invention, there is a venturi trough within the bore of the muzzle brake below the travel path of the projectile and its propelling gases. Gaseous conduit means are coupled to the venturi trough to vent propellant gases from the trough. This gaseous conduit comprises a gaseous exit channel directed downwardly from the path of the projectile from the muzzle. Gaseous flow adjustment means are coupled to the exit channel to adjust the flow of propellant gas through the exit channel. Preferably, there are two gaseous exit channels, each directed downwardly with respect to the path of the projectile from the muzzle. A first such exit channel is further directed to the left of that path. A second exit channel is further directed to the right of that path. Individual gaseous flow adjustment means are provided with each of these exit channels such that gas flow through each channel may be individually and selectedly adjusted.

In a presently preferred embodiment of the muzzle brake, the brake has a concave face from which the projectile and portion of the propellant gases exit. The shape of the face distorts projectile shock wave and breaks up muzzle blast.

A highly useful embodiment of the invention houses the muzzle brake within a flash hider. The flash hider itself provides the means by which the brake is coupled to the muzzle of the weapon. To reduce weapon recoil, the flash hider includes a retrojet, gas exit channel for exhausting a portion of the propellant gases rearwardly and outwardly with respect to the path of the projectile through the bore of the weapon and the brake. Preferably, there are a plurality of these retrojet gas exit channels. The plurality of retrojet channels is arrayed to inhibit undesired, transverse movement of the muzzle as the weapon is fired as well as reducing the recoil experienced when firing the weapon. It is noted and claimed that the addition of such an array of retrojet gas exit channels to the prior art muzzle brakes in itself represents a significant improvement in such prior art muzzle brakes.

A DETAILED DESCRIPTION OF THE INVENTION

Figure 1:
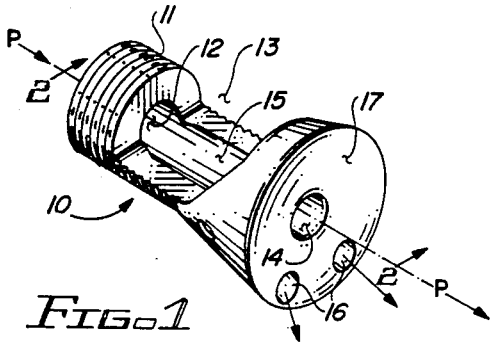
FIG. 1 is a perspective view of the improved muzzle brake.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

The improved muzzle brake of the invention is illustrated in perspective in FIG. 1. As already noted, all muzzle brakes employ a large opening which opens upwards above the path P of the projectile in the illustration. The improved muzzle brake 10 has a bore 12 along which the projectile travels. Above the bore 12 is a void 13 through which propelling gases may escape. The upward escape of propellant gases through the void 13 create a reactionary, downward force on brake 10. Brake 10 has a threaded end 11 which provides the means whereby brake 10 is coupled to the muzzle of an automatic or semi-automatic firing weapon. Threaded end 11 may be thread coupled directly to the muzzle of a weapon, or, as later herein disclosed in a presently preferred embodiment, coupled to the muzzle through an intervening flash hider which houses brake 10. A projectile traveling along path P enters the muzzle brake to the left of the illustration, traveling through bore 12, and exiting the face 17 of muzzle 10 through opening 14, the right-most extension of bore 12 in the illustration.

Figure 2:
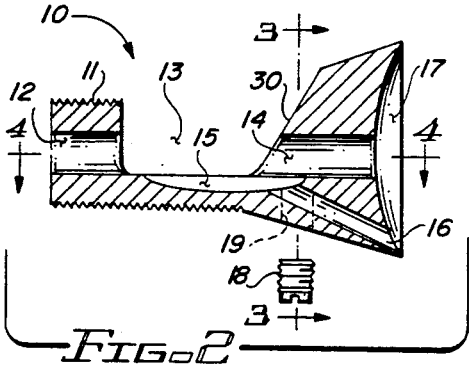
FIG. 2 is a side sectional view of the muzzle brake taken along the lines 2—2 of FIG. 1.

A venturi trough 15 is introduced into bore 12 and is best illustrated in the cross sectional view of FIG. 2. As the gases which propel a projectile through bore 12 pass over the venturi trough 15, a venturi effect is created reducing the pressure within trough 15 and drawing propelling gases downward into the trough. The pressure within trough 15 is still greater than atmospheric pressure and exit channel 16 is provided to serve as an exit for the propelling gases drawn into venturi trough 15. As the drawings indicate, exit channel 16 is a conduit guiding gases from venturi trough 15 in a forward direction, along the path of a projectile traveling within bore 12.

A flow adjustment screw 18 is coupled into the conduit of gaseous escape channel 16 via threaded opening 19. By adjustment of screw 18, the amount of gases passing through the conduit of channel 16 may be controlled from a given maximum, determined by the diameter of conduit 16, to essentially zero flow when adjustment screw 18 is inserted to the greatest depth possible in threaded opening 19.

By creating a void 13 large enough to exert a downward force which slightly more than compensates for the rise of the muzzle as the weapon is fired, minor offsetting adjustment of the travel of the muzzle, under firing conditions, may be made by use of adjustment screw 18.

Figure 3:
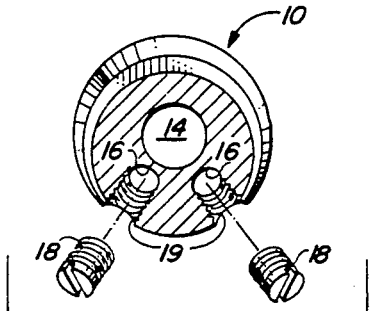
FIG. 3 is a sectional view of the muzzle brake taken along line 3—3 of FIG. 2.

Ideally, conduit 16 comprises two channels offset to the left and the right of the path P of the projectile. These two exit channels may be best seen in FIG. 1 as the channels exit the face 17 of muzzle 10 and in the cross sectional plan view of FIG. 4. Each of the two exit channels 16 includes a gas flow adjustment screw 18 as illustrated in the cross sectional view of FIG. 3, taken along line 3—3 of FIG. 2.

With two exit channels 16, one to the left and one to the right of path P of the projectile, selected adjustment of screws 18 will control any tendency of the muzzle to move to the left or to the right as the weapon is fired.

Figure 4:
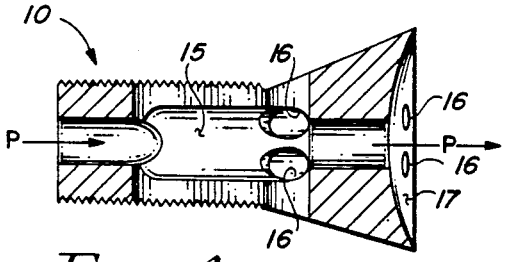
FIG. 4 is a cross sectional view of the brake taken along lines 4—4 of FIG. 2.

As is best seen if FIGS. 2 and 4, face 17 is concave in shape. The shape of face 17 is selected to distort the muzzle shock wave and break up the muzzle blast. This, in-turn, results in less deflection of the fired weapon to which brake 10 is coupled.

To the right of void 13, as illustrated in FIG. 2, is a sloping face 30. Propelling gases traveling along the path P of the projectile striking this sloping face 30 are propelled outwardly upwards and to each side of muzzle brake 10. The reactionary forces of the propelling gases striking the sloping face 30 and escaping from muzzle brake 10 act to defeat the natural tendency of the muzzle of the fired weapon to climb and to drift.

Figure 5:
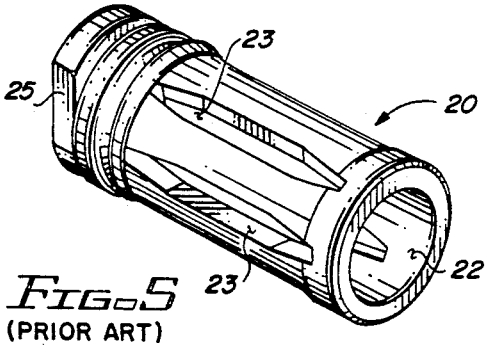
FIG. 5 (PRIOR ART)
FIG. 5 is a perspective view of a government issued flash hider used with automatic and semi-automatic weapons.
Figure 6:
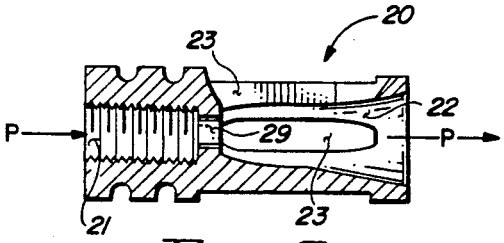
FIG. 6 (PRIOR ART)
FIG. 6 is a cross sectional view of the government issued flash hider of FIG. 5.
Figure 7:
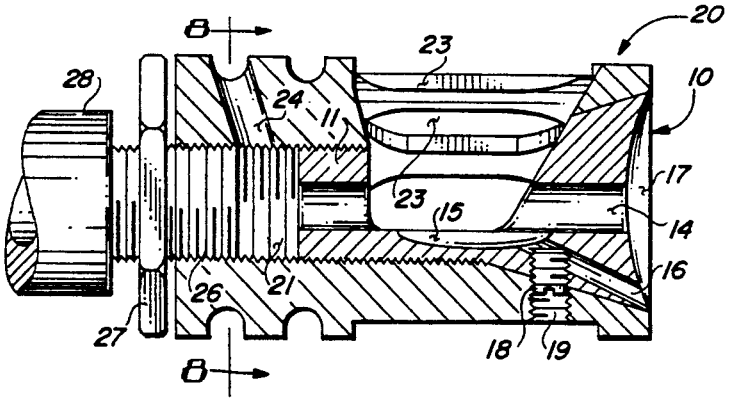
FIG. 7 is a cross sectional view of that flash hider with its interior retro-fitted to accept the muzzle brake of FIG. 1. The flash hider is shown screw fastened to the muzzle of a weapon.
Figure 8:
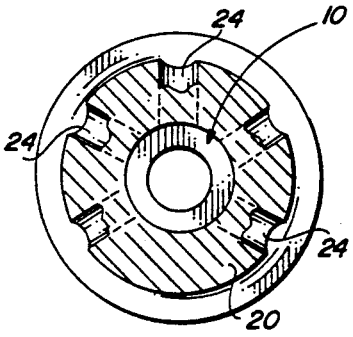
FIG. 8 is a cross sectional view along lines 8—8 of FIG. 7.

As can be seen in FIGS. 1, 2 and 4, muzzle brake 10 has a generally conic structural shape. This shape is not mandatory but has been selected to further enhance the utility of muzzle brake 10 by permitting the muzzle brake to be fitted into and housed within a government issue flash hider utilized on automatic and semi-automatic firing weapons. Such a flash hider 20 is illustrated in FIGS. 5 through 8. FIG. 5 presents a perspective view of flash hider 20. A threaded bore 21, FIG. 6, is intended to be screw fastened to the muzzle 26 of a weapon 28, FIG. 7. When flash hider 20 is screw fastened to muzzle 26, jam nut 27 is drawn into intimate, interfering contact with flash hider 20 to prevent loosening of the coupling of the flash hider with muzzle 26 when the weapon 28 is fired. To assist in tightening jam nut 27 against flash hider 20, the flash hider is provided with flats 25, FIG. 5, to which a wrench may be applied.

The interior 22 of flash hider 20 is generally conical in shape. It is because of this that the structure of muzzle brake 10, as shown in FIGS. 1, 2 and 4, assumes a generally conical shape as well. Note however, that there is no provision within the interior 22 of flash hider 20 to accept and couple to muzzle brake 10. The bore 29 in flash hider 20 through which the projectile passes in exiting the weapon 28 is too small to accept the threaded end 11 of muzzle brake 10.

To enable the coupling of muzzle brake 10 to flash hider 20, the threaded bore 21 is extended through flash hider 20 into its interior 22, effectively eliminating the reduced bore 29. See FIG. 7 wherein the now through-threaded bore 21 accepts threaded muzzle 26 of weapon 28 and threaded end 11 of muzzle brake 10. Threaded openings 19 extend upwardly through the exterior of flash hider 20 and into the exit channels 16 to permit the adjustment of gas flow through exit channels 16 as earlier noted.

With muzzle brake 10 effectively housed within flash hider 20, a further improvement is available. A retrojet channel 24 is emplaced in the body of flash hider 20 so as to extend from the exterior of flash hider 20 into threaded bore 21 through which the projectile and its propellant gases must pass. The retrojet gas escape channel 24 is inclined rearwardly, for example approximately 45° from the flight path of the projectile, so as to create a jet reaction force which opposes the nominal recoil of the fired weapon. Further recoil reducing and stabilizing effects are achieved by creating an array of such retrojet channels 24 as indicated in the cross sectional view of FIG. 8. The reactive forces of the gases jetting through such an array of retrojet gas escape channels is to inhibit undesired transverse movement of the muzzle of weapon 28 as the weapon is fired.

What has been disclosed herein is an improved muzzle brake having a generally upward opening void from which escaping gases create a downwardly directed reaction force and a sloping face on which the propelling gases collide and expand and deflect to either side and upward of the muzzle brake to defeat the natural tendency of the muzzle of a weapon to climb and drift. Below the generally upward opening void, within the floor of the bore of the muzzle is a venturi trough in which a lowered pressure region of propelling gases is created by the high speed passage of the propelling gases down to the bore of the muzzle brake. This lowered pressure region within the venturi trough is still in excess of the environmental pressure exterior of the muzzle brake so that gases within the venturi trough escape through channels directed downwardly and to the left and right of the projectile path. Gas escaping through these downward, left and right deflected channels is adjustable in flow so that any tendency of the weapon to drift left or right or to move downwardly may be compensated for. The muzzle brake has a structural shape which accommodates it to be fitted within a government issued flash hider. Once so housed within the flash hider, further modification is made to introduce retrojet gas escape channels through the walls of the flash hider into the bore through which the projectile and its propelling gases pass. Propelling gases escaping through these rearwardly directed retrojet channels offset the recoil of the weapon. By arraying these retrojet channels, a balanced set of reaction forces is derived which tends to offset transverse movement of the muzzle of the weapon.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, THAT WHICH IS CLAIMED IS:

1. In a muzzle brake, having means for coupling to the muzzle of a weapon, said brake having a bore through which a projectile and propelling gases pass in exiting said muzzle and an opening above said bore for venting a portion of said propelling gases to create a downward reaction force for offsetting the nominal rise of said muzzle experienced when said weapon is fired, the improvement comprising:

a venturi trough within said bore below the travel path of said projectile and said propelling gases; and gaseous conduit means coupled to said venturi trough for venting propelling gases from said venturi trough.

2. The improvement of claim 1 wherein said brake has a face from which said projectile and a portion of said propellant gases exit, said face having a concave shape selected to distort projectile shock wave and brake up muzzle blast.

3. The improvement of claim 1 wherein said means for coupling to the muzzle of a weapon comprises housing means in which said brake is housed and coupled to said muzzle, said housing means further having a plurality of retrojet-gas exit channels coupled to said bore for exhausting a portion of said propellant gases rearwardly and outwardly with respect to the path of said projectile to reduce the rearward thrust experienced by said weapon when fired, said plurality of retrojet, gas exit channels being arrayed to inhibit undesired, transverse movement of said muzzle as said weapon is fired.

4. The improvement of claim 1 wherein said gaseous conduit means comprise a gaseous exit channel directed downwardly from the path of said projectile from said muzzle.

5. The improvement of claim 4 further comprising gaseous flow adjustment means coupled to said exit channel for adjusting the flow of propellant gas through said exit channel.

6. The improvement of claim 1 said means for coupling to the muzzle of a weapon comprising a flash hider in which said brake is housed and further having a bore in line with the path of said projectile.

7. The improvement of claim 6 wherein said flash hider includes a retrojet, gas exit channel for exhausting a portion of said propellant gases rearwardly and outwardly with respect to the path of said projectile to reduce the rearward thrust experienced by said weapon when fired.

8. The improvement of claim 6 wherein said flash hider includes a plurality of retrojet, gas exit channels for exhausting a portion of said propellant gases rearwardly and outwardly with respect to the path of said projectile to reduce the rearward thrust experienced by said weapon when fired, said plurality of retrojet, gas exit channels being arrayed to inhibit undesired, transverse movement of said muzzle as said weapon is fired.

9. The improvement of claim 8 wherein said flash hider comprises a flash hider for automatic and semi-automatic weapons, said flash hider having a retro-fitted interior structure for coupling said improvement therein.

10. The improvement of claim 8 wherein said gaseous conduit means comprises first and second gaseous exit channels each directed downwardly with respect to the path of said projectile from said muzzle, said first exit channel being further directed to the left of said path, said second exit channel being further directed to the right of said path.

11. The improvement of claim 10 further comprising first gaseous flow adjustment means coupled to said first exit channel, and second gaseous flow adjustment means coupled to said second exit channel whereby the flow of propellant gas through each of said first and second exit channels may be individually and selectedly adjusted.

12. The improvement of claim 1 wherein said gaseous conduit means comprises first and second gaseous exit channels each directed downwardly with respect to the path of said projectile from said muzzle, said first exit channel being further directed to the left of said path, said second exit channel being further directed to the right of said path.

13. The improvement of claim 12 further comprising first gaseous flow adjustment means coupled to said first exit channel, and second gaseous flow adjustment means coupled to said second exit channel whereby the flow of propellant gas through each of said first and second exit channels may be individually and selectedly adjusted.

14. The improvement of claim 13 wherein said brake has a face from which said projectile and a portion of said propellant gases exit, said face having a concave shape selected to distort projectile shock wave and brake up muzzle blast.

15. The improvement of claim 13 said means for coupling to the muzzle of a weapon comprising a flash hider in which said brake is housed and further having a bore in line with the path of said projectile.

16. The improvement of claim 15 wherein said flash hider includes a retrojet, gas exit channel 24 for exhausting a portion of said propellant gases rearwardly and outwardly with respect to the path of said projectile to reduce the rearward thrust experienced by said weapon when fired.

17. The improvement of claim 15 wherein said flash hider includes a pluality of retrojet, gas exit channels for exhausting a portion of said propellant gases rearwardly and outwardly with respect to the path of said projectile to reduce the rearward thrust experienced by said weapon when fired, said plurality of retrojet, gas exit channels being arrayed to inhibit undesired, transverse movement of said muzzle as said weapon is fired.

18. The improvement of claim 17 wherein said flash hider comprises a flash hider for automatic and semi-automatic weapons, said flash hider having a retro-fitted interior structure for coupling said improvement therein.

19. The improvement of claim 17 wherein said brake has a face from which said projectile has a portion of said propellant gases exit, said face having a concave shape selected to distort projectile shock wave and brake up muzzle blast.

20. The improvement of claim 19 wherein said flash hider comprises a flash hider for automatic and semi-automatic weapons, said flash hider having a retro-fitted interior structure for coupling said improvement therein.

21. In a muzzle brake, having means for coupling to the muzzle of a weapon, said brake having a bore through which a projectile and propelling gases pass in exiting said muzzle and an opening above said bore for venting a portion of said propelling gases to create a downward reaction force for offsetting the nominal rise of said muzzle experienced when said weapon is fired, the improvement comprising:

said means for coupling to the muzzle of a weapon being a flash hider housing said muzzle brake, said flash hider having first and second gaseous exit channels coupled to said bore, each directed forwardly and downwardly with respect to the path of said projectile from said muzzle, said first exit channel being further directed to the left of said path, said second exit channel being further directed to the right of said path said first and said second gaseous channels each being a conduit for guiding said propelling gases downwardly, the first to the left, the second to the right.

* * * * *